US009150382B2

(12) United States Patent
Allen et al.

(10) Patent No.: US 9,150,382 B2
(45) Date of Patent: Oct. 6, 2015

(54) APPARATUS AND METHOD FOR FEEDING AND CONVEYING ITEMS

(71) Applicant: J&L GROUP INTERNATIONAL, LLC, Keithville, LA (US)

(72) Inventors: Robert M. Allen, Spokane Valley, WA (US); Aaron Cleveland, Clayton, WA (US); Marius Batrin, Liberty Lake, WA (US); Richard W. Wilkinson, Friendswood, TX (US); Michael Harrington, Spokane, WA (US)

(73) Assignee: ALLIANCE MACHINE SYSTEMS INTERNATIONAL, LLC, St. Louis, MO (US)

( * ) Notice: Subject to any disclaimer, the term of this patent is extended or adjusted under 35 U.S.C. 154(b) by 105 days.

(21) Appl. No.: 13/795,821

(22) Filed: Mar. 12, 2013

(65) Prior Publication Data

US 2013/0259631 A1 Oct. 3, 2013

Related U.S. Application Data

(60) Provisional application No. 61/619,125, filed on Apr. 2, 2012.

(51) Int. Cl.
*B65H 83/02* (2006.01)
*B65H 29/50* (2006.01)

(52) U.S. Cl.
CPC ..... *B65H 83/02* (2013.01); *B65H 29/50* (2013.01); *B65H 2301/42134* (2013.01); *B65H 2301/42322* (2013.01); *B65H 2511/214* (2013.01); *B65H 2511/22* (2013.01); *B65H 2513/10* (2013.01); *Y10S 414/105* (2013.01)

(58) Field of Classification Search
USPC ..... 198/592; 271/191, 199, 201, 203, 256, 271/270; 414/792.7, 793.1, 793.3, 793.5, 414/793.8, 794.4, 794.5, 794.6
See application file for complete search history.

(56) References Cited

U.S. PATENT DOCUMENTS

| | | | | |
|---|---|---|---|---|
| 3,030,107 | A * | 4/1962 | Stidwill | 271/199 |
| 3,143,344 | A | 8/1964 | Miller et al. | |
| 3,671,753 | A | 6/1972 | Lucas | |
| 4,313,600 | A | 2/1982 | Mosburger | |
| 5,152,515 | A | 10/1992 | Acquaviva | |
| 5,326,088 | A * | 7/1994 | Newsome | 271/3.23 |

(Continued)

FOREIGN PATENT DOCUMENTS

| | | |
|---|---|---|
| EP | 0 033 799 | 8/1981 |
| EP | 0 844 201 | 5/1998 |

OTHER PUBLICATIONS

EPO Extended Search Report dated Sep. 25, 2013 for EP Appln. No. 13160183.3.

*Primary Examiner* — Gregory Adams
(74) *Attorney, Agent, or Firm* — Dorsey & Whitney LLP

(57) ABSTRACT

One embodiment of the present disclosure relates to a stacking device including a conveyor belt configured to move one or more items towards a receiving storage hopper configured to receive the one or more items from the conveyor belt. The one or more items may form a stack of items in the receiving storage hopper. The stacking device may further include a sensing device configured to determine a level of the stack of items in the receiving storage hopper. The stacking device may be configured to adjust a height of the conveyor belt relative to the storage hopper based on the level of the stack of items in the receiving storage hopper.

25 Claims, 11 Drawing Sheets

(56) References Cited

U.S. PATENT DOCUMENTS

| | | | | | |
|---|---|---|---|---|---|
| 5,439,209 | A * | 8/1995 | Runzi | 271/251 |
| 5,697,753 | A * | 12/1997 | Aurora et al. | 414/398 |
| 5,904,465 | A * | 5/1999 | Villacieros Fernandez | 414/794.5 |
| 5,997,238 | A * | 12/1999 | Garrard et al. | 414/789 |
| 6,003,861 | A * | 12/1999 | Iizumi et al. | 271/215 |
| 6,318,954 | B1 * | 11/2001 | Voss et al. | 414/794.4 |
| 6,427,999 | B1 * | 8/2002 | Christofferson | 271/201 |
| 7,066,462 | B2 * | 6/2006 | Rilitz et al. | 271/217 |
| 7,585,146 | B2 * | 9/2009 | Widmer et al. | 414/793.9 |
| 2003/0015835 | A1 * | 1/2003 | Post et al. | 271/149 |
| 2003/0108416 | A1 * | 6/2003 | Schererz et al. | 414/794.4 |
| 2008/0128983 | A1 * | 6/2008 | Prim et al. | 271/270 |

* cited by examiner

APPARATUS AND METHOD FOR FEEDING AND CONVEYING ITEMS

FIELD OF THE INVENTION

The present disclosure relates generally to automated feeding devices, and in particular to automated devices for feeding and conveying items with optimized control.

BACKGROUND OF THE INVENTION

A "prefeeder" is a device that handles blank sheets of, for example, corrugated material. The prefeeder receives a stack of blank sheets, divides the stack into blocks, and feeds the blocks into a finishing machine in an intermittent shingled stream. Particularly, a block pusher prefeeder may receive the stack of blank sheets, lift the stack up, divide the stack into measured blocks, and then feed the sheets off the bottom of the block under a vertical stop in a continuous shingled stream for delivery into the finishing machine hopper.

With conventional pusher technology, a stack of flat sheet stock enters the block pusher prefeeder. The lead edge of the stack is registered against a vertical stop, such as a backstop. The block pusher plate resides behind and to the top of the stack. When there is a call for another block of sheets, the stack rises, such that the stack is between the backstop and the block pusher plate. The block pusher plate then moves forward to push off a block of sheets from the top of the stack. In the standard configuration, the bottom of the block pusher plate is aligned with the top of the backstop, so as to produce a horizontal plane. This horizontal plane defines the separation point in the stack, wherein the sheet above the plane is the bottom sheet of the block and the sheet below the plane is the top sheet of the stack.

When there is down warp, the leading edge of the stack is lower than the trailing edge of the stack. As a result, when the block pusher plate moves forward to deliver a block of sheets, the block pusher plate stalls due to the sheets that are captured/jammed between the block pusher plate and the backstop. When there is up warp, the leading edge of the stack is higher than the trail edge of the stack. When the block pusher plate moves forward to deliver a block of sheets, trailing sheets (i.e., sheets that are not aligned with the block or the stack) result.

Current block pusher prefeeders allow the operator to select a warp mode which lifts the block pusher plate. Elevating the bottom of the block pusher plate relative to the backstop allows the block pusher plate to convey forward and push a down warped block of sheets successfully off the stack.

Warp mode cannot be enabled permanently due to the potential for a trailing sheet condition when running flat, or non-warped, sheets. When the bottom of the block pusher plate and the top of the backstop are not correctly aligned in elevation (i.e., the bottom of the block pusher plate is above the top of the backstop), a scenario arises when running flat sheets where the bottom sheet(s) of the block, or the top sheet(s) of the stack, begin to move, but then stall and are no longer aligned with the block or the stack. This may cause issues with the manufacturing line efficiency.

With the selector switch for warp mode at the operator station, the operator is required to make the decision regarding when to use the warp mode and when to disable warp mode. Upon visual inspection of a stack, the operator can select a mode to allow the prefeeder to handle warp or select a mode where the prefeeder handles no warp. Use of a selector switch results in an increased risk for human error. For example, the operator may enable warp mode at times when warp mode is undesirable, thereby causing trailing sheets to occur. Similarly, the operator may disable warp mode at times when warp mode is desirable. Thus, the block pusher plate may stall against the back of the stack due to down warp. As an additional example, the operator may enable warp mode where warp mode is desirable (i.e., the stack contains warped sheets). However, the sheets at the bottom of the stack may be pressed flat due to the weight of the stack. That is, the amount of warp may diminish from the top of the stack to the bottom of the stack, and therefore, with warp mode enabled, trailing sheets may be present in the last few block pushes of the stack. Thus, to have an efficient operation, the operator must always be cognizant of whether warp is present in the stack and select the appropriate mode.

Another problem with conventional feeders arises when items moved by the conveyor belts are dropped into the finishing hopper, which stacks the items as they are dropped off of the conveyor belt. Many conventional feeders do not include means for effectively controlling the drop distance of the items, which extends from the top of the conveyor belts to the top of the stack of items formed in the hopper. When the drop distance of the items is too large, the items may be damaged as they are deposited in the hopper. On the other hand, the hopper may overflow when the stack of items is too high. Each of these events may result in damage to the items, and/or jamming of the stacking device.

To control the drop distance of the items, many conventional feeders alternate between starting and stopping the conveyor belt of the stacking device and/or the finishing conveyor belt of the finishing machine. For example, these feeders may start the conveyor belt of the stacking device while stopping the finishing conveyor belt to increase the height of the stack in the hopper and decrease the drop distance between the belt and the top of the stack. Alternatively, conventional feeders may stop the conveyor belt of the stacking device while running the finishing conveyor belt to decrease the height of the stack and increase the drop distance. However, these solutions are not effective in maintaining the stack at a constant level within the hopper, and further result in jamming of the stacking device due to the accumulation of items during the stopping and starting of the belts. Accordingly, there is a continuing need in the art for automated feeding devices with optimized control that overcome one or more of the limitations of conventional approaches.

BRIEF SUMMARY OF THE INVENTION

The present disclosure includes an apparatus and method for conveying, stacking, and un-stacking items, and has particular application for stacking sheets of corrugated board, paperboard, fiberboard, or other sheet material from an entry or line conveyor or other delivery means.

In one embodiment, a stacking device can be coupled between a conveyor and a receiving hopper. The stacking device can be configured to adjust a drop distance from the conveyor onto the top of a stack of stackable items already in the receiving hopper (for example, a level of the top of the stack can be determined by one or more sensors). This can have the effect that items are not damaged by an excessive drop distance, and do not have overflow-related problems from an insufficient drop distance. The drop distance can be adjusted by one or more techniques that can have the effect of maintaining the drop distance within a desirable range, such as between a relative minimum and a relative maximum. Maintaining the drop distance more than the relative minimum can help prevent overflow-related problems. Maintaining the drop distance less than the relative maximum can help prevent drop damage.

For a first example, the drop distance can be adjusted by altering a position of the conveyor, such as a height of the delivery end of the conveyor above the receiving hopper (either the height of the entire conveyor, or just the height of its delivery end, could be adjusted). This can have the effect that the stackable items are dropped from a location either closer to, or farther from, the top of the stack already in the receiving hopper. For a second example, the drop distance can be adjusted by altering a speed at which stackable items enter the receiving hopper. This can have the effect that the stackable items enter and exit the receiving hopper at a speed that maintains the top of the stack already in the receiving hopper relatively closer to, or farther from, the conveyor (such as with respect to a minimum fill level or a maximum fill level).

In one embodiment, apparatus including the stacking device can perform one or more methods that maintain the drop distance within a desirable range, such as between a relative minimum and a relative maximum. The conveyor can be responsive to the sensor in the stacking device, and can perform method steps that maintain the drop distance within the desirable range. For a first example, the delivery end of the conveyor can be raised or lowered with respect to the stacking device (either the height of the entire conveyor, or just the height of its delivery end, could be adjusted). For a second example, the conveyor can increase or decrease its speed, with the effect of maintaining a desirable fill level range. Each of these method steps can maintain a desirable drop distance and help prevent stacking problems.

As described herein, in one embodiment, a stacking device including a conveyor belt may be configured to move one or more items towards a receiving storage hopper configured to receive the one or more items from the conveyor belt. The one or more items may form a stack of items in the receiving storage hopper. The stacking device may further include a sensing device configured to determine a level of the stack of items in the receiving storage hopper. The stacking device may be configured to adjust a height of the stacking conveyor belt relative to the storage hopper based on the level of the stack of items in the receiving storage hopper. For example, the height of the stacking conveyor belt relative to the storage hopper can be adjusted by altering an angle of the stacking conveyor, with the effect that a delivery end of the stacking conveyor is different or higher, relative to the storage hopper.

As described herein, in another embodiment, the stacking device may be configured to raise the height of the stacking conveyor belt relative to the storage hopper if the level of the stack of items in the receiving storage hopper is above a target fill level. In a further embodiment, the stacking device may be configured to lower the height of the conveyor belt relative to the storage hopper if the level of the stack of items in the receiving storage hopper is below a minimum fill level. In another embodiment, the stacking device may be further configured to adjust a speed of the conveyor belt based on the level of the stack of items in the receiving storage hopper.

In some embodiments, the sensing device may include a laser sensor that emits a predetermined wavelength of light in the form of a beam. In other embodiments, the laser sensor may be positioned within the stacking conveyor belt. In additional embodiments, the sensing device may include one or more photoelectric sensors that are positioned within the hopper.

As described herein, in another embodiment, a conveyor belt can be configured to move one or more items towards a receiving storage hopper configured to receive the one or more items from the conveyor belt. The one or more items may form a stack of items in the receiving storage hopper. The stacking device may further include a sensing device configured to determine a level of the stack of items in the receiving storage hopper. The stacking device may be configured to adjust a speed of the conveyor belt based on the level of the stack of items in the receiving storage hopper.

As described herein, in a further embodiment, the stacking device may be configured to decrease the speed of the conveyor belt when the level of the stack of items is higher than a target fill level. In another embodiment, the stacking device may be configured to increase the speed of the conveyor belt when the level of the stack of items is lower than a minimum fill level. In additional embodiments, the stacking device may further include a finishing machine including a finishing conveyor belt, and the stacking device may be configured to adjust the speed of the conveyor belt based on the level of the stack of items in the receiving storage hopper.

As described herein, another embodiment relates to a method for stacking items. The method may include moving one or more items along a conveyor belt at a predetermined speed, dropping the one or more items into a hopper to form a stack of items in the hopper, measuring a level of the stack of items in the hopper, and altering the speed of the conveyor belt based on the level of the stack of items in the hopper.

As described herein, in another embodiment of the method, the altering step may include decreasing the speed of the conveyor belt if the level of the stack of items in the hopper is above a target fill level. In a further embodiment, the altering step may include increasing the speed of the conveyor belt if the level of the stack of items in the hopper is below a target fill level.

As described herein, another embodiment relates to a method for stacking items, including moving one or more items along a conveyor belt, dropping the one or more items into a hopper to form a stack of items in the hopper, measuring a level of the stack of items in the hopper, and altering a height of the conveyor belt relative to the hopper based on the level of the stack of items in the hopper.

As described herein, in a further embodiment, the altering step may include lowering the conveyor belt if the stack of items in the hopper is lower than a target fill level and the conveyor belt is running at a maximum speed. In another embodiment, the altering step includes raising the conveyor belt if the stack of items in the hopper is higher than a target fill level. In another embodiment, the altering step includes lowering the conveyor belt if the stack of items in the hopper is lower than a minimum fill level.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

The use of the same reference numerals in different drawings indicates similar or identical items.

DETAILED DESCRIPTION

The various embodiments of the apparatus and method for conveying and stacking items in accordance with the present disclosure may be used with an automated stacking device for maintaining an ideal relative position between a feeder assembly and a finishing machine thereof.

Figure 1:
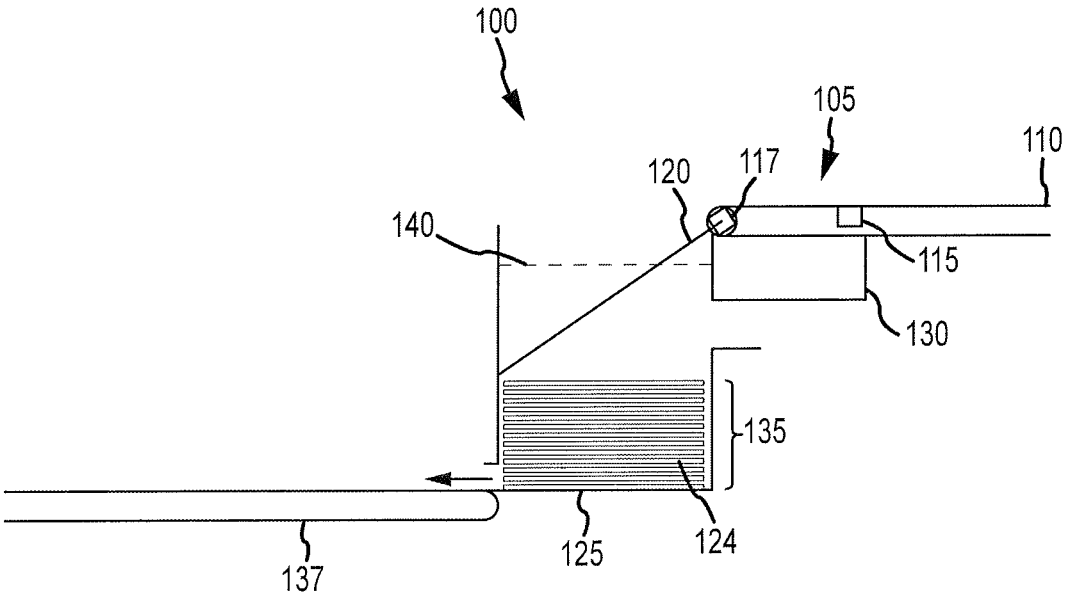
FIG. 1 is a semi-detailed, semi-diagrammatical representation of a stacking device in accordance with one embodiment of the present disclosure.

FIG. 1 illustrates a side view of a stacking device in accordance with one embodiment of the present disclosure. Referring to FIG. 1, a stacking device 100 is shown. The items stacked by the device 100 may include a variety of things, such as a shingle made from corrugated board, paperboard, and/or fiberboard. Although not specifically shown in FIG. 1, the items stacked may be ultimately stacked onto frames or pallets made of wood, metal, and/or plastic, where they are stored for transportation purposes.

The device 100 may include a carrier or conveyor 105 for receiving incoming items to be stacked. The conveyor 105 may include an endless band or belt 110 that extends longitudinally along the conveyor 105. Depending upon the embodiment ultimately implemented, the belt 110 may be made of a variety of materials and configurations. For example, in some embodiments, the belt 110 may be made from a single rubber layer. In other embodiments, the belt 110 may be made of multiple layers that include an underlying layer, which provides linear strength, and a cover layer over the underlying layer. In these embodiments, the underlying layer may be cotton and/or metallic composites and the cover layer may be plastic, rubber, or combinations thereof. Additionally, in some embodiments, the belt 110 may include one or more grooves to increase gripping strength of items being conveyed along the belt 110. Furthermore, in still other embodiments, the belt 110 may be a woven structure with openings or gaps throughout. In some embodiments, the belt 110 may be made of plastic, plastic with rubber inserts, and/or plastic chain. Further, some embodiments may implement the belt 110 as a single wide belt, multiple thinner belts, and/or a belt with skate wheels.

In some embodiments, the device 100 may be configured to move the conveyor 105. For example, the conveyor 105 may be moved in vertical, horizontal, angular, or other directions. This may be accomplished using a robotic arm (not shown) that is coupled to the conveyor 105. Such robotic arms may be found in assembly lines, and may extend from above or below the conveyor 105 to support the weight of the conveyor 105. Other embodiments may utilize other types of devices or structures for moving the conveyor 105, as appropriate.

As shown in FIG. 1, the conveyor 105 may include a sensor 115 that senses whether items are being conveyed along the belt 110. In some embodiments, the sensor 115 may be a photoelectric sensor, or photoeye. In these embodiments, the photoeye may detect the distance, absence, or presence of an item on the belt 110 by using a light transmitter and a photoelectric receiver. Various types of photoeyes may be ultimately implemented depending upon the particular embodiment, such as an opposed, or through beam type of photoeye, a retro reflective type of photoeye, and/or a proximity-sensing, or diffused type of photoeye.

An opposed or through-beam arrangement consists of a receiver located within the line-of-sight of a transmitter that may be located beneath the belt 110. For example, the receiver may be above the belt 110 (not specifically shown in FIG. 1). In this mode, an object may be detected when a light beam from the transmitter is blocked in transmission between the receiver and transmitter. A retro reflective arrangement places the transmitter and receiver at the same location (e.g., beneath the belt 110 in the sensor housing 115) and uses a reflector, such as a stack 124 (discussed in greater detail below), to bounce the light beam back from the transmitter to the receiver. In this embodiment, an object may be sensed when the beam is interrupted and fails to reach the receiver. A proximity-sensing or diffused arrangement is where the energy transmitted by the transmitter reflects off objects being conveyed along the belt 110 and back to the receiver. In this mode, an object is detected when the receiver sees the transmitted source rather than when it fails to see it.

In the embodiments where the sensor 115 is a photoeye, the sensor may have different operational modes to determine the presence of items on the belt 110, such as "light operate" mode or "dark operate" mode. In light operate mode, photoeyes may generate a signal when the receiver "receives" the transmitter signal, whereas in dark operate mode, photoeyes may generate a signal when the receiver "does not receive" the transmitter signal. Examples of commercial products that may be used to implement the photoeye 115 include an Efector O1D100 photoelectric sensor from IFM of Exton, Pa. Of course, other embodiments are possible where the sensor 115 is implemented using different technology, such as laser, capacitive, background suppression diffuse, ultrasonic, pressure, and/or weight-sensing technologies.

Referring still to FIG. 1, the conveyor 105 may include an additional sensor 117 that may be positioned at the end of the belt 110 as shown in the illustrated embodiment. The sensor 117 may be a laser sensor that emits a predetermined wavelength of light in the form of a beam 120. In this manner, the laser beam 120 may measure distance, and/or the absence or presence of items falling off the belt 110 into a hopper 125 as the beam is interrupted. Although the beam 120 is shown projecting at a certain angle with respect to the major plane of the conveyor 105, the precise angle of the beam 120 may vary depending upon the embodiment implemented.

As shown in FIG. 1, the conveyor 105 also may include a housing 130 that may contain motors and/or electrical circuitry for moving the conveyor 105 up and/or down, or at a greater or lesser angle, with respect to the hopper 125. Such up and down movement or angular movement may reduce the drop height of the items from the conveyor 105 to the hopper 125.

Figure 2:
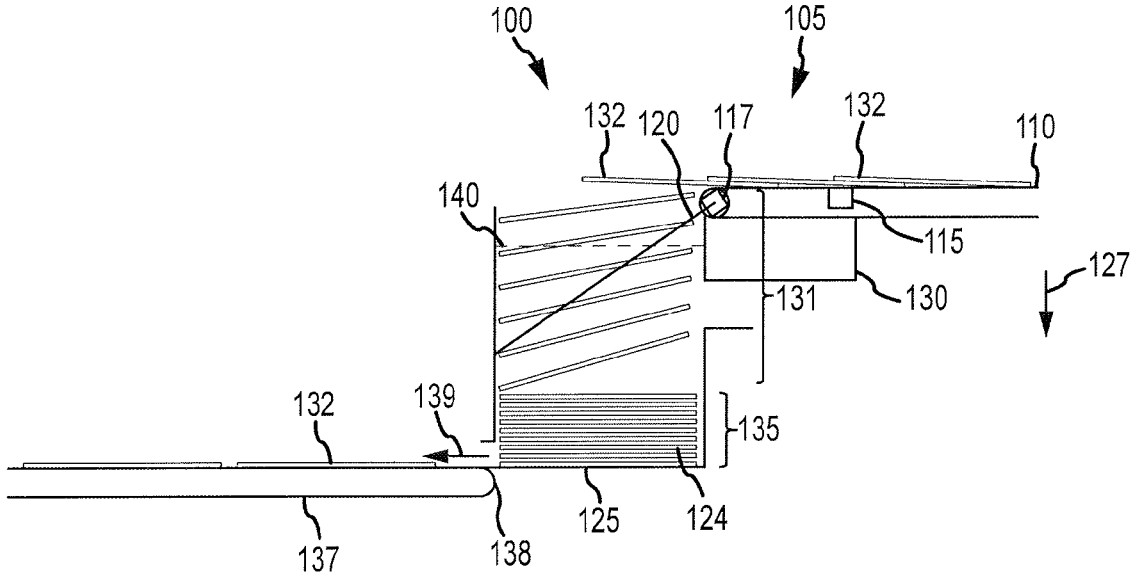
FIG. 2 is a semi-detailed, semi-diagrammatical representation of the stacking device shown in FIG. 1 in a first stage of operation.

FIG. 2 illustrates the stacking device 100 of FIG. 1 during operation. Referring now to FIG. 2 in conjunction with FIG. 1, the general operation of the device 100 will now be described. During operation, the device 100 may convey items 132 along the belt 110 of the conveyor 105. In some embodiments, these items 132 may be delivered to the conveyor 105 from other devices within the same manufacturing facility. Thus, if the belt 110 stops completely, then the devices that deliver the items 132 to the belt 110 may get backed up.

As shown in FIG. 2, the items 132 moved along the belt 110 may be placed onto the belt 110 in a "shingled" fashion such that the end of one item overlays the beginning of a subsequent item. The belt 110 may rotate along the conveyor 105 in a counter-clockwise direction, causing the items 132 to spill off the end of the belt 110 and begin accumulating in the hopper 125. Because of the shingled arrangement, the items 132 may fall into the hopper in a separate and semi-orderly fashion, forming a stack 124 of items 132 as they accumulate in the hopper 125. In some embodiments, a user of the device 100 may prime the hopper 125 with one or more items so that the incoming items 132 have a surface to land on, and thereby minimize damage associated with the items 132 falling into the hopper 125.

The stack 124 of items 132 in the hopper 125 may have a height 135, defined as the distance between the top and bottom of the stack 124 within the hopper 125. As shown in FIG. 2, one or more items 132 from the hopper 125 may be fed out through an aperture or opening 138 in the direction indicated by the arrow 139 to other portions of the device 100 or facility. In some embodiments, the items 132 may be moved along a finishing conveyor belt 137, which moves the items 132 to another location within the manufacturing facility. Referring to FIGS. 1 and 2, the device 100 may include a target fill level 140, which may represent a target fill level entered by the user or a custom level calculated by the device 100. The custom level may be a target fill level 140 that is determined based on the height of the conveyor belt 105 relative to the hopper 125, which may be a predetermined height or a height set by the user operating the machine. In some embodiments, the target fill level 140 may be the height 135 of the stack 124 that best minimizes the potential for damage of the items 132 as they fall off the conveyor 105 and onto the stack 124 in the hopper 125. In other embodiments, the target fill level 140 may be the height 135 of the stack 124 that best minimizes the potential for jams. The device 100 may attempt to maintain the stack 124 in the hopper 125 at the target fill level 140 during operation of the device 100.

As previously discussed, the sensor 117 positioned at the end of the conveyor belt 110 may be configured to detect the height 135 of the stack 124 using the laser beam 120. In some embodiments, the sensor 117 may be filtered, such that items 132 falling off of the conveyor 105 and occluding or blocking the beam 120 may be disregarded by the sensor 117 in determining the height 135 of the stack 124. This may be accomplished through the use of a timer that is triggered when the beam 120 is blocked, and turned off once the beam 120 is unblocked. If the beam 120 is not blocked for over a minimum threshold time, the device 100 may restart the timer for the next item 132 detected by the sensor 117. However, if the beam 120 is blocked for over a minimum threshold time, device 100 may determine that the stack 124 is occluding the beam 120, and that the target fill level 140 has been reached. Other embodiments may utilize other methods for preventing inaccurate sensor 117 readings as to the height 135 of the stack 124. For example, in other embodiments, a signal from the sensor 117 can be low-pass filtered, with the effect of removing effects on the signal from possible temporary occlusion of the beam 120 by falling items 132.

FIG. 2 illustrates one possible stage during operation of the stacking device 100, in which the height 135 of the stack 124 in the hopper 125 is below the target fill level 140. When the sensor 117 detects that the height 135 of the stack 124 in the hopper 125 is below the target fill level 140, the device 100 may increase the speed at which the conveyor belt 110 is rotated, thereby increasing the rate at which items 132 are deposited into the hopper 125. In some embodiments, the speed of the conveyor belt 110 may be increased to a speed that is faster than the rotational speed of the finishing conveyor 137. This serves to increase the height 135 of the stack 124 so that it may reach the target fill level 140 at a faster rate. In other embodiments, the finishing conveyor 137 may include one item per linear distance (e.g., 1 item per foot) whereas the conveyor belt 110 may include several items per the same linear distance in a shingled fashion (e.g., six items per foot). Thus, varying the ratio of items per linear distance between the finishing conveyor 137 and the conveyor belt 110 also may varying the height 135 of the stack 124.

Referring still to FIG. 2, the device 100 may also lower the conveyor belt 110 (represented by arrow 127), if possible, to decrease the drop distance 131 of the items 132 from the conveyor belt 110 to the top of the stack 124. Decreasing the drop distance 131 of the items 132 deposited into the hopper 125 may serve to prevent damage to the items 132, as well as malfunctioning of the device 100 due to potential jams caused by improper placement of the items 132 in the hopper 125. In some cases, the conveyor belt 110 may already be positioned at its lowest possible height, and the device 100 may therefore be unable to lower the conveyor belt 110 (although the speed of the belt 110 can still be increased to increase the height 135 of the stack 124).

In some embodiments, the device may simultaneously increase the speed at which the conveyor belt 110 is rotated and lower the conveyor belt 110, to simultaneously increase the height 135 of the stack 124 and decrease the drop distance 131 of items 132 into the hopper 125. However, in other embodiments, the device may only increase the rotational speed of the conveyor belt 110 or lower the conveyor belt 110. In further embodiments, the device may alternate between adjusting the speed of the conveyor belt 110 and the height of the conveyor belt 110 during operation.

Figure 3:
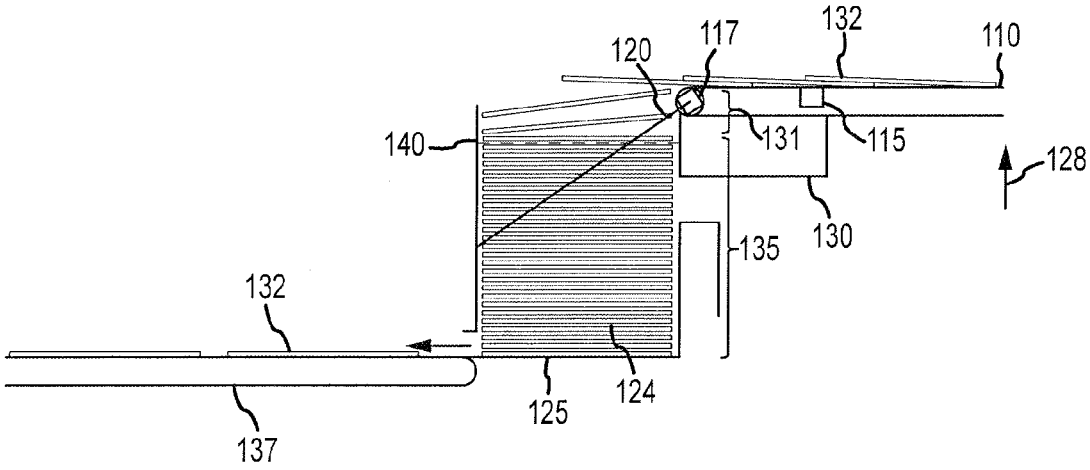
FIG. 3 is a semi-detailed, semi-diagrammatical representation of the stacking device shown in FIG. 1 in a second stage of operation.

FIG. 3 illustrates the device 100 in another stage of operation, in which the height 135 of the stack 124 is higher than the target fill level 140. In such cases, when the sensor 117 detects that the height 135 of the stack 124 in the hopper 125 is above the target fill level 140, the device 100 may decrease the speed at which the conveyor belt 110 is rotated, thereby decreasing the rate at which items 132 are deposited into the hopper 125, and decreasing the height 135 of the stack 124 such that the top of the stack 124 is lowered back to the target fill level 140. In some embodiments, the speed of the conveyor belt 110 is decreased to a speed that is slower than the rotational speed of the finishing conveyor 137. In other embodiments, the ratio between of items per linear distance on the finishing conveyor 137 (which are not shingled) compared with the conveyor belt 110 (which are shingled) may be varied to vary the height 135 of the stack 124.

When the height 135 of the stack 124 is higher than the target fill level 140, the device 100 may also raise the conveyor belt 110 (represented by arrow 128), if possible, to increase the drop distance 131 of the items 132 deposited into the hopper 125. This serves to maintain a desirable drop distance 131 between the conveyor belt 110 and the top of the stack 124, and prevent items 132 from being damaged or disordered as they are deposited into the hopper 125. For example, if the conveyor belt 110 was in the lowest position, such as for priming the hopper, then belt 110 could be raised until the target hopper level plus the ideal drop height is reached.

In some embodiments, the device may simultaneously decrease the speed at which the conveyor belt 110 is rotated and lower the conveyor belt 110, to simultaneously decrease the height 135 of the stack 124 and increase the drop distance 131 of items 132 into the hopper 125. However, in other embodiments, the device may only decrease the rotational speed of the conveyor belt 110 or raise the conveyor belt 110. In further embodiments, the device may alternate between adjusting the speed of the conveyor belt 110 and the height of the conveyor belt 110. In other embodiments, the speed of finishing conveyor 137 may be increased.

As discussed above, some embodiments of the stacking device 100 may attempt to maintain the stack 124 in the hopper 125 at the target fill level 140. There are many advantages to maintaining the hopper 125 at a constant target level 140, including maintaining a relatively constant drop distance of items 132 onto the stack 124, which prevents damage to the items 132 as they are dropped onto the stack 124. Another reason for maintaining the stack 124 at a constant level is to maintain a relatively constant weight on the hopper 125, which prevents jamming of the device 100. For example, conventional finishing devices often use vacuum to convey the first item from the bottom of the stack 124, and in the event that the stack 124 is too tall, then the weight of the stack 124, may be too great for the vacuum to work properly. As the fill level required in the hopper 125 is further reduced, which reduces the risk that the hopper 125 is emptied, and when the hopper 125 is emptied, it may cause production to stop altogether and/or necessitate human intervention to re-prime the hopper 125. Further, increasing and decreasing the rotational speed of the conveyor belt 110, rather than starting and stopping the conveyor belt 110, which is common in existing devices, serves to prevent clumping or grouping of the items 132 in the hopper 125, and allows for more even distribution of the items 132 being dropped into the hopper 125.

Figure 4A:
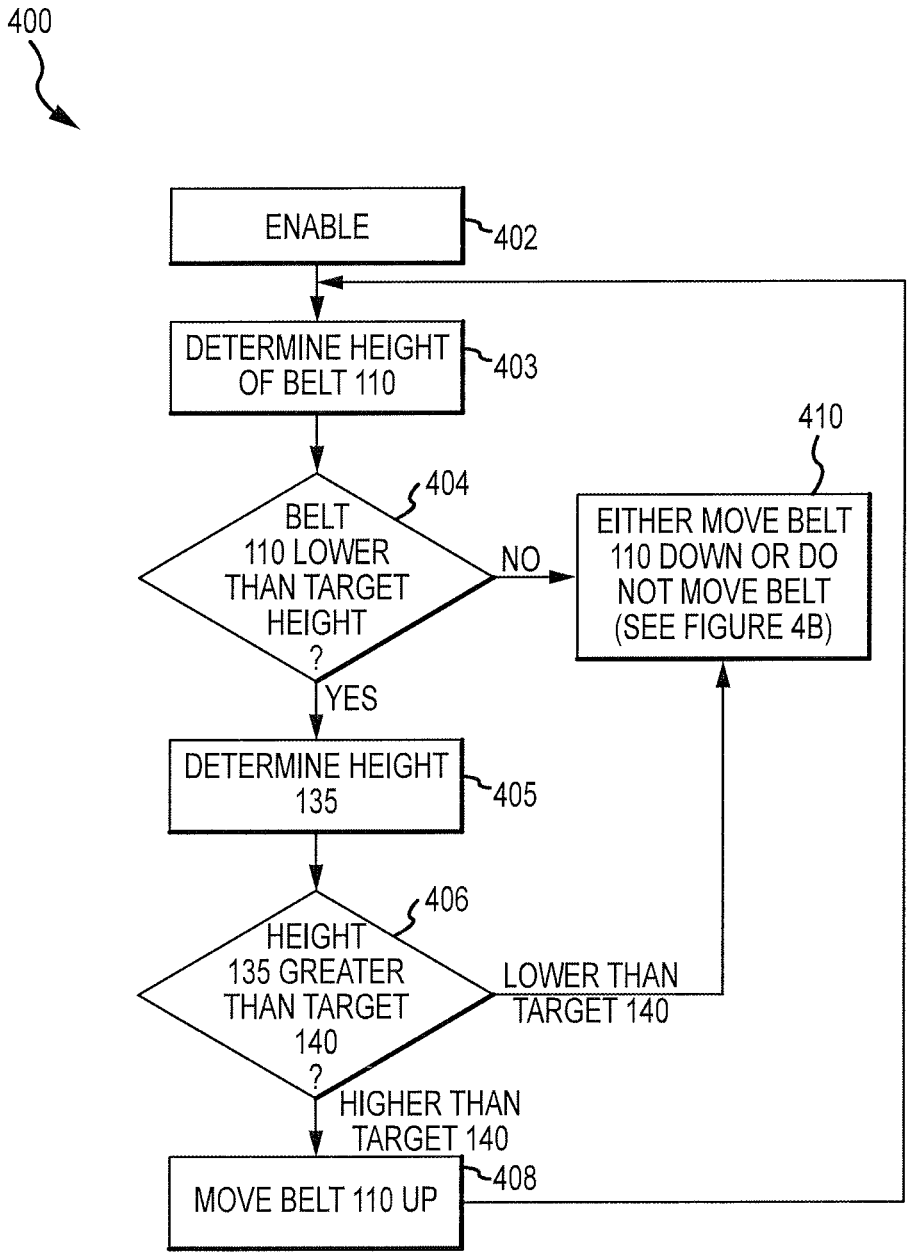
FIG. 4A illustrates a method for adjusting the height of the conveyor belt of a stacking device in accordance with one embodiment of the present disclosure.

FIG. 4A illustrates one embodiment of a method 400 for adjusting the height of the conveyor belt 110 (as shown in FIGS. 1-3) of a stacking device 100. The height of the conveyor belt 110 is defined herein as the distance from the bottom of the hopper 125 to the top of the conveyor belt 110. As shown in FIG. 4A, the method 400 begins with step 402, in which the device 100 is enabled to sense the height 135 of the stack 124. Next, the method 400 proceeds to step 403 where the height of the belt 110 above the hopper 125 is determined. The method 400 then proceeds to step 404, in which the device 100 determines whether the height of the belt 110 is lower than a target height. This target height may be set by the user in advance or calculated by the device 100 during operation. In the embodiments where the target height of the belt 110 is set by the user, the target height may be entered by the user operating the device 100, and the device 100 may utilize this target height to calculate the position of the target fill level 140. If, in step 404, the device determines that the belt 110 is lower than the target height, then in step 405, the device 100 determines the height 135 of the stack 124. If, in step 404, the device 100 determines that the belt height is higher than the target height, then, in step 410, the device 100 may either move the belt 110 down or maintain the current position of the belt 110, as further discussed with reference to FIG. 4B.

Next, in step 406, the height 135 of the stack 124 is compared to the target fill level 140. If, in step 406, the device determines that the height 135 is greater than the target fill level 140, then, in step 408, the device may raise the belt 110, which increases the drop distance of the items 132 from the belt 110. The method 400 may then proceed back to step 403. If, however, in step 406, the device determines that the height 135 is lower than the target fill level 140, then, in step 410, the device 100 may either move the belt 110 down or maintain the position of the belt 110, as further discussed with reference to FIG. 4B.

Figure 4B:
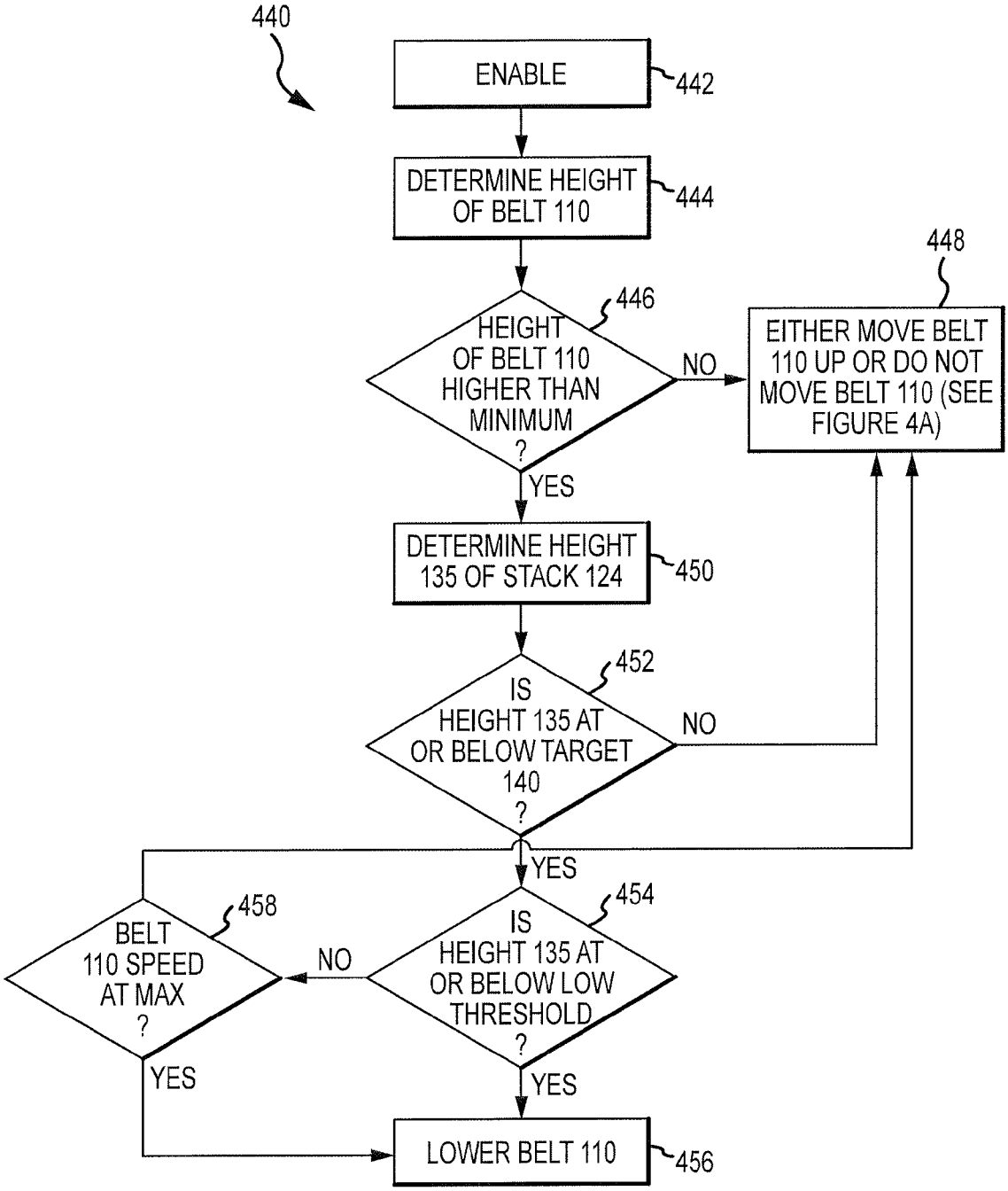
FIG. 4B illustrates a method for adjusting the height of the conveyor belt of a stacking device in accordance with one embodiment of the present disclosure.

FIG. 4B illustrates a method 440 for adjusting the height of the conveyor belt 110 (as shown in FIGS. 1-3) of a stacking device 100. As shown in FIG. 4B, the method 440 begins with step 442, in which the device 100 is enabled to sense the height 135 of the stack 124 (described previously with regard to FIG. 4A). The method 400 then proceeds to step 444, in which the device 100 determines the height of the belt 110. Again, the height of the conveyor belt 110 is defined herein as the distance from the bottom of the hopper 125 to the top of the conveyor belt 110. Next, in step 446, the height of the belt 110 determined in step 444 is compared to a target height that was set by a user or calculated by the device 100. If, in step 446, the device 100 determines the belt 110 height is not higher than the target level (e.g., the belt 110 cannot be lowered any further), then in step 448, the device 100 will either raise the belt or maintain the current position of the belt, as further discussed with reference to FIG. 4A. If, in step 446, the device determines the belt height is lower than the target height level, then, in step 450, the device 100 will determine the height 135 of the stack 124. If, in step 452, the device determines the height 135 is either at or above the target fill level 140, then in step 448, the device 100 will either raise the belt or maintain the current position of the belt. If, in step 452 the device 100 determines the height 135 is below the target fill level 140, then, in step 454 the device 100 will determine whether the height 135 is at or below a low threshold level. For example, in some embodiments, the low threshold may be 25 millimeters of product, while in other embodiments, it may be determined by the operator. If, in step 454, the device 100 determines the height 135 of the stack 124 is at or below the low level, then, in step 456, the device 100 will lower the belt 110. If, however, in step 454, the device 100 determines the height 135 of the stack 124 is above the low level, then, in step 458, the device 100 will determine whether the conveyor belt speed is equal to the maximum belt speed. If, in step 458, the device 100 determines that the conveyor belt speed is equal to the maximum belt speed, then in step 456 the device 100 will lower the belt. If, however, in step 458, the device 100 determines the conveyor belt speed is less than the maximum belt speed, then in step 448, the device 100 will either raise the belt or maintain the position of the belt.

Figure 5:
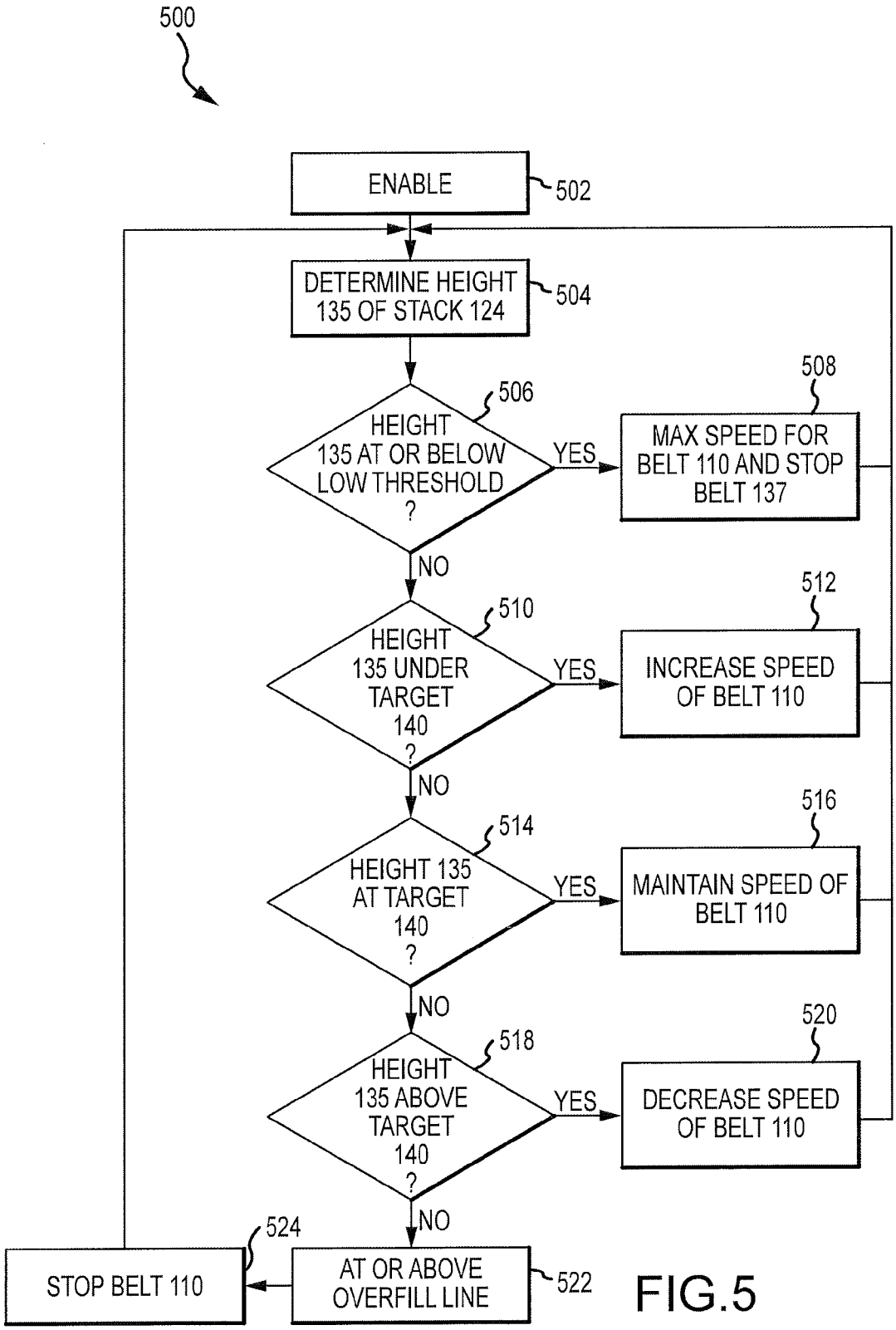
FIG. 5 illustrates a method for adjusting the speed of the conveyor belt of a stacking device in accordance with one embodiment of the present disclosure.

FIG. 5 illustrates one embodiment of a method 500 for adjusting the speed of the conveyor belt 110 (as shown in FIGS. 1-3) of a stacking device 100. As shown in FIG. 5, the method 500 begins with step 502, in which the device 100 is enabled to sense the height 135 of the stack 124. In step 504, the device 100 may sense the height 135 of the stack 124. If, in step 506, the device 100 determines that the height 135 is at or below a low threshold level, then in step 508, the device 100 will rotate the conveyor belt 110 at the maximum speed, and will stop the finishing belt 137 from moving the items 132 out of the hopper 125. The method 500 may then proceed back to step 504, in which the device 100 may again determine the height 135 of the stack 124. Accordingly, the device 100 will continue rotating the belt 110 at the maximum speed until the device 100 detects that the height 135 of the stack 124 has grown such that it extends past the low threshold level.

If, in step 506, the device 100 determines that the height 135 is above the low threshold level, then, in step 510, the device 100 may determine whether the height 135 is under the target fill level 140. If, in step 510, the device 100 determines that the height 135 is under the target fill level 140, then in step 512, the device 100 will increase the speed of the conveyor belt 110. The method 500 may then proceed back to step 504, in which the device 100 may again determine the height 135 of the stack 124. Accordingly, the device 100 will continue increasing the speed of the belt 110 until the device 100 determines that the height 135 extends at or above the target fill level 140.

If, in step 510, the device 100 determines that the height 135 is not under the target fill level 140, then, in step 514, the device 100 may determine whether the height 135 is at the target fill level 140. If, in step 514, the device 100 determines that the height 135 is at the target fill level 140, then in step 516, the device 100 may keep the rotational speed of the conveyor belt 110 constant. The method 500 may then proceed back to step 504, in which the device 100 may again determine the height 135 of the stack 124.

If, in step 514, the device 100 determines that the height 135 is not at the target fill level 140, then, in step 518, the device 100 may determine whether the height 135 is above the target fill level 140. If, in step 518, the device 100 determines that the height 135 is above the target fill level 140, then in step 520, the device 100 may decrease the speed of the conveyor belt 110. The method 500 may then proceed back to step 504, in which the device 100 may again determine the height 135 of the stack 124.

If, in step 518, the stacking device 100 determines that the height 135 is not above the target fill level 140, then, in step 522, the device 100 may determine that the height 135 is at or above the overfill line (i.e., a maximum threshold level either set by the manufacturer of the device 100 or the user). The overfill line may be, for example, the level at which the items 132 in the stack 124 are in danger of overflowing from the hopper 125. The device 100 may then halt the conveyor belt 110 in step 524. The method 500 may then proceed back to step 504, in which the device 100 may again determine the height 135 of the stack 124.

In some embodiments, the method 500 illustrated in FIG. 5 may be performed in conjunction with the method 400 illustrated in FIGS. 4A and 4B, such that the height of the conveyor belt 110 and the speed of the conveyor belt 110 may be adjusted at the same time using the methods 400 and 500 described above. In other embodiments, the method 500 illustrated in FIG. 5 may be performed independently of the method of FIGS. 4A and 4B. For example, the conveyor belt 110 may be maintained in a fixed position, and the speed of the belt 110 may be adjusted as set forth in the method 500 shown in FIG. 5. It should be noted that the steps illustrated in FIGS. 4A, 4B, and/or 5 may be performed with a proportional-integral-derivative (PID) controller. For example, in the embodiment illustrated in FIG. 5, the process input variable may be the hopper target fill level 140, the set point may be the target fill level 134, and the process output variable may be the conveyor belt 110 speed. Further, in the embodiment illustrated in FIGS. 4A and 4B, the PID may control the conveyor belt 110 using this same input and set point. In one embodiment, the PID control loop can use parameter values including PID_P=0.2, PID_I=0.4, and PID_D=0.0. However, those skilled in the art would recognize that these particular parameter values are merely exemplary, and that other parameter values are within the scope and spirit of the invention.

Figure 6:
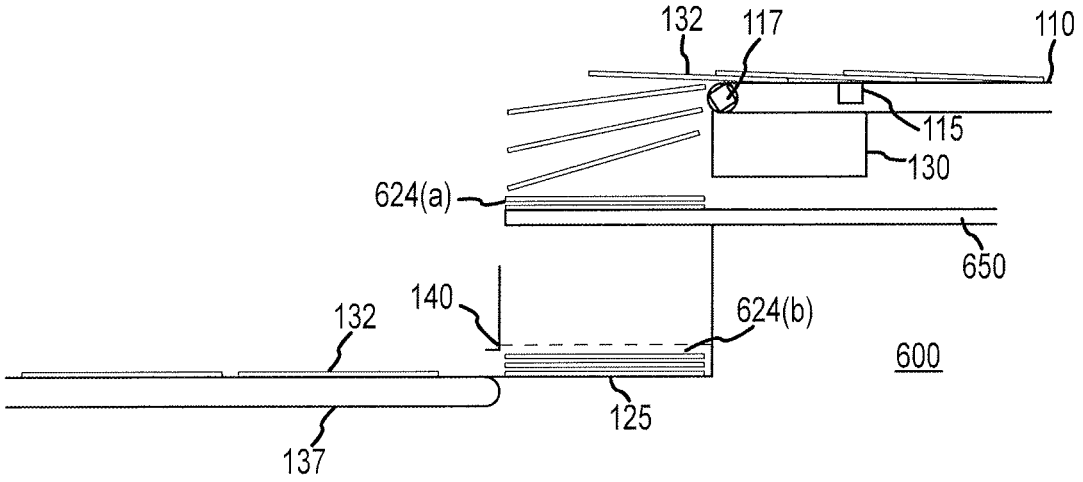
FIG. 6 is a semi-detailed, semi-diagrammatical representation of a stacking device in accordance with one embodiment of the present disclosure.

FIG. 6 illustrates another embodiment of the stacking device 600 that includes a hopper loading fork 650 that can be extended from the device 600 above the hopper 125. In this embodiment, items 132 carried along the conveyor belt 110 may be dropped onto the top of the loading fork 650 to form a first stack 624(*a*) on top of the loading fork 650. Once the stack 624(*a*) has reached a certain level, the loading fork 650 may be retracted into the device 600 and the stack 624(*a*) accumulated on the fork 650 may be dropped into the hopper 125 (see 624(*b*), representing a pile that was previously dropped into the hopper 125). A finishing belt 137 may clear the items 132 of the stack 624(*b*) out of the hopper 125. Similar to the embodiment shown in FIGS. 1-3, this embodiment may include a sensor 117 that measures the level of the stack 624(*b*) in the hopper 125 as the loading fork 650 deposits the stacks 624(*a*) of items 132 accumulated from the conveyor belt 110, and the device 600 may adjust the speed of the conveyor belt 110 and/or the height of the conveyor belt 110 based on the height 135 of the stack 624(*b*) in the hopper 125.

Figure 7:
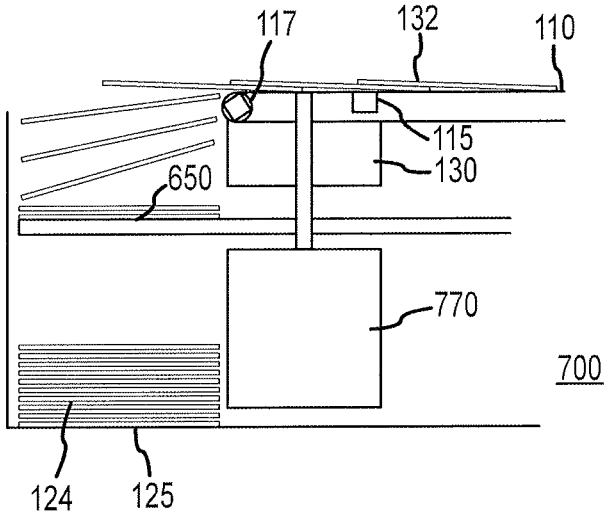
FIG. 7 is a semi-detailed, semi-diagrammatical representation of a stacking device in accordance with one embodiment of the present disclosure.

FIG. 7 illustrates another embodiment of the stacking device 700. Similar to the device 600 shown in FIG. 6, this device 700 includes a loading fork 650 that extends away from the device 700 above the hopper 125. In some embodiments, the loading fork 650 functions similarly to that described above with respect to the device 600 shown in FIG. 6. Additionally, the device 700 further includes a backstop 770 that is connected to the conveyor belt 110, such that the backstop 770 is raised and lowered with the conveyor belt 110. In contrast to prior embodiments, the backstop 770 is positioned on the trailing end of the stack 724, rather than the finishing or forward end of the stack 724. The motion of the backstop 700, together with the conveyor belt 110, causes the trailing edges of the items 132 to tip. In some embodiments, the hopper may further include one or more tamping devices that are configured to straighten the stack 124 in the hopper 125.

Figure 8:
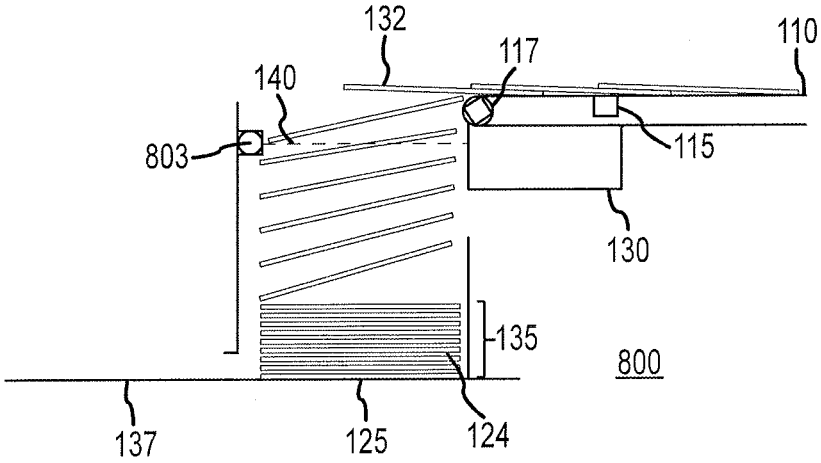
FIG. 8 is a semi-detailed, semi-diagrammatical representation of a stacking device in accordance with one embodiment of the present disclosure.

FIG. 8 illustrates another embodiment of the stacking device 800 that utilizes a single photoeye 803. In this embodiment, the photoeye 803 maybe positioned within the hopper 125 such that it is substantially level with the target fill level 140. As discussed above, the photoeye 803 may be configured to sense the presence of an item 132 as it falls off the belt 110 and passes the sensed region of the photoeye 803. In some embodiments, the photoeye 803 may include a transmitter and a receiver located within the line of sight of the transmitter (e.g., the receiver may be positioned on the other side of the hopper 125), and the transmitter may sense the presence of an item 132 when a light beam from the transmitter is blocked during transmission to the receiver. Alternatively, the photoeye 803 may have a retroreflective arrangement that places the transmitter and receiver at the same location and utilizes a reflector to bounce the light beam back from the transmitter to the receiver. In further embodiments, the photoeye 803 may be a proximity-sensing photoelectric sensor.

Once an item 132 is sensed by the photoeye 803, the device 800 may start a timer. The device 800 may stop the timer once the item is no longer sensed by the photoeye 803. If the photoeye 803 senses the presence of an item 132 for longer than a threshold period of time, the device may determine that the stack height 135 has grown above the target fill level 140. In such cases, the device 800 may slow down the conveyor belt 110 to minimize the growth of the stack 124. On the other hand, if the photoeye 803 does not sense the presence of an item 132 for longer than a threshold period of time, the device 800 may determine that the stack height 135 is below the target fill level 140. In such cases, the device 800 may increase the speed of the conveyor belt 110 to increase the height 135 of the stack 124.

Figure 9:
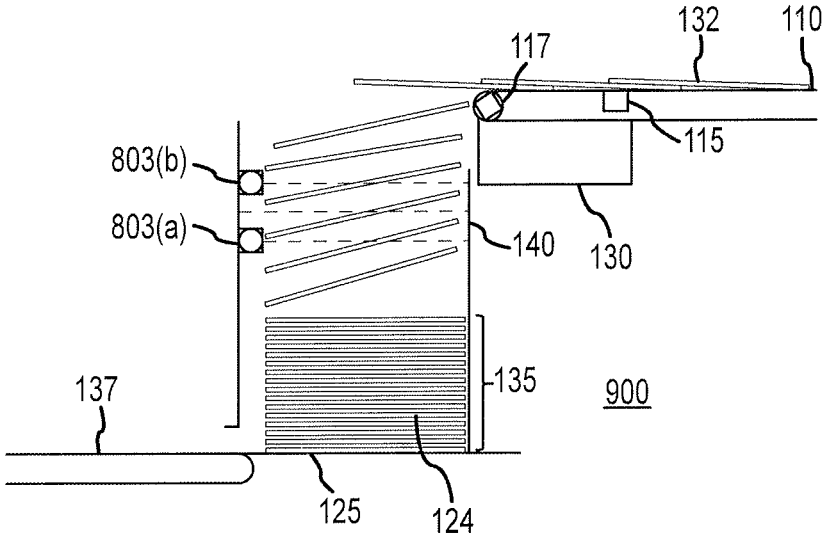
FIG. 9 is a semi-detailed, semi-diagrammatical representation of a stacking device in accordance with one embodiment of the present disclosure.

Other embodiments may utilize two or more photoeyes 803(*a*), 803(*b*) that are positioned within the hopper 125. In one embodiment of the stacking device 900, shown in FIG. 9, two photoeyes 803(*a*), 803(*b*) may be positioned at different levels within the hopper 125, with one photoeye 803(*b*) being positioned above the target fill level 140 and the other photoeye 803(*a*) being positioned below the target fill level 140. In one embodiment, the photoeyes 803(*a*), 803(*b*) may be positioned about three inches apart. If the bottom photoeye 803(*a*) senses the presence of an item 132 for longer than a threshold period of time, the device 900 may determine that the stack height has grown such that it extends above the bottom photoeye 803(*a*). If the top photoeye 803(*b*) also senses the presence of an item 132 for longer than a threshold period of time, the device may determine that the stack height has grown such that it extends above the top photoeye 803(*b*). Alternatively, if the top photoeye 803(*b*) does not sense the presence of an item 132 for longer than the threshold period of time, the device 900 may determine that the stack height is at the target fill level 140, i.e., between the two photoeyes 803(*a*), 803(*b*).

Figure 10:
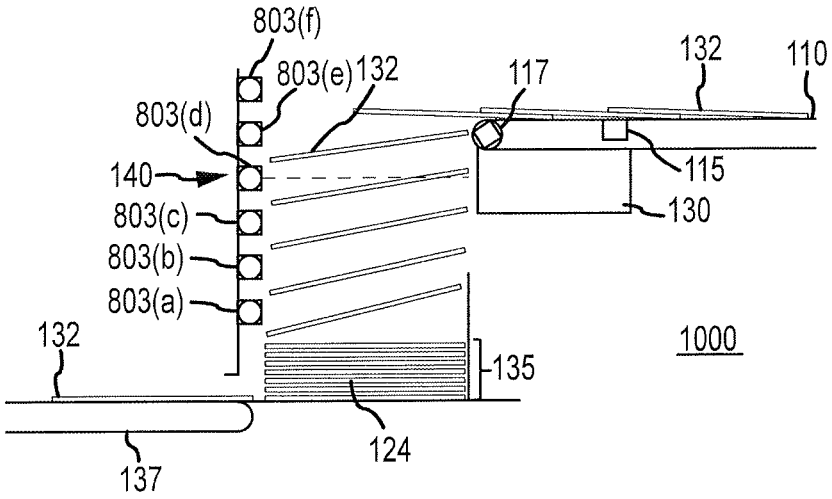
FIG. 10 is a semi-detailed, semi-diagrammatical representation of a stacking device in accordance with one embodiment of the present disclosure.

In a further embodiment of the stacking device 1000, illustrated in FIG. 10, additional photoeyes 803(*a*)-803(*f*) may be positioned at different levels within the hopper 125, allowing the device 1000 to more accurately sense the height 135 of the stack 124 within the hopper 124. In this embodiment, each photoeye 803(*a*)-803(*f*) may be configured to determine if the stack height 135 extends above or below it based on whether it senses the prolonged presence (or absence) of an item 132. As is shown, one of the photoeyes 803(*d*) may be positioned at the target fill level 140. Accordingly, the device 1000 may determine that an item is above the target fill level 140 when the sensor 803(*e*) immediately above the target fill level 140 senses the prolonged presence of an item 132. Alternatively, the device 1000 may determine that an item 132 is below the target fill level 140 when the sensor 803(*c*) immediately below the target fill level 140 senses the prolonged presence of an item 132, and the sensor 803(*d*) at the target fill level 140 does not sense the prolonged presence of an item 132. Further sensors 803(*b*), 803(*a*), 803(*f*) may be positioned at other levels of the hopper 124 to designate, e.g., that the stack 124 is at the low level, that the stack 124 is at the overfill limit, that the stack 124 is virtually empty, or at other heights 135 within the hopper 124. The device 1000 may then utilize one or more of the methods described above in FIGS. 4A, 4B, and 5 to adjust the height of the conveyor belt 110 and/or the speed of the belt 110.

Other embodiments may utilize other types of photoeyes 803(*a*)-803(*f*) in connection with the device 1000. For example, in one embodiment, the photoeyes 803(*a*)-803(*f*) may include sets of infrared photodiodes and phototransistors mounted at different hopper levels on a single circuit board strip that extends along the height of the hopper 125. Each photodiode/phototransistor set may be configured to sense a different frequency of infrared light. A microprocessor controller, or other processing component for operating the photoeyes 803(*a*)-803(*f*), may also be mounted on the circuit board strip. In some embodiments, a lens with a coating to filter non-infrared frequencies may also be used to filter out ambient light. As an example, the lens may be formed from plastic, and may have a 12-inch focal length. The microprocessor controller may pulse each photodiode at a different frequency, allowing the device 1000 to distinguish between the different photodiode/phototransistor sets, which are each responsive to a different frequency. In one embodiment, the controller may further allow for transmitting the status of each photodiode/phototransistor set to a processing device, which may determine the height 135 of the stack 124 within the hopper 124 based on the received status information.

Although the various embodiments of the present disclosure have been described, persons of skill in the art will appreciate that changes may be made in form and detail without departing from the spirit and scope of the present disclosure.

We claim:

1. Apparatus including a conveyor configured to move one or more items toward a receiving hopper, the receiving hopper configured to receive the items into a stack thereof;

a sensor configured to determine a level of the stack;

a controller coupled to the conveyor and configured to maintain a drop distance between the conveyor and the level of the stack within a desirable range that includes at least a minimum distance between the level of the stack and the level of the conveyer; wherein the controller is configured to adjust a speed of the conveyor when the drop distance between the conveyor and the level of the stack is not within the desirable range;

the receiving hopper is configured to feed items out of the hopper from off of a bottom of the stack;

the controller is configured to perform at least one of the following as item are feed into and out of the hopper:

decrease the speed of the conveyor when the level of the stack is more than a target fill level so as to decrease the rate at which items are deposited into the hopper; or increase the speed of the conveyor when the level of the stack is less than the target fill level fill level so as to increase the rate at which items are deposited into the hopper.

2. Apparatus as in claim 1, wherein the controller is configured to adjust a height of the conveyor with respect to the receiving hopper when the drop distance between the conveyor and the level of the stack is not within the desirable range.

3. Apparatus as in claim 1, wherein the controller is configured to perform at least one of the following:

raise the conveyor with respect to the receiving hopper when the level of the stack is more than a target fill level; or lower the conveyor with respect to the receiving hopper when the level of the stack is less than a minimum fill level.

4. Apparatus as in claim 1, wherein the controller is configured to adjust an angle of the conveyor with respect to the receiving hopper when the drop distance between the conveyor and the level of the stack is not within the desirable range.

5. Apparatus as in claim 1, wherein the controller is configured to perform at least one of the following:

raise the delivery end of the conveyor with respect to the receiving hopper when the level of the stack is more than a target fill level; or lower the delivery end of the conveyor with respect to the receiving hopper when the level of the stack is less than a minimum fill level.

6. Apparatus as in claim 1, wherein a second sensor is positioned within the conveyor, and is configured to detect whether items are being conveyed by the conveyor.

7. Apparatus as in claim 1, wherein the controller is configured to maintain the level of the stack at about a constant level.

8. Apparatus as in claim 1, wherein a second sensor is positioned within the conveyor, and is configured to detect whether items are falling from the conveyor into the receiving hopper.

9. Apparatus as in claim 8, wherein an output from the second sensor is filtered; and the filtered output indicates when a target fill level is reached.

10. Apparatus as in claim 1, wherein the controller is configured to stop the conveyer when the level of the stack is at or above an overfill line.

11. Apparatus as in claim 1, wherein the sensor is configured to measure a distance between the stack and the sensor and to determine the level of the stack based on the distance.

12. A method, including steps of moving one or more items on a conveyor toward a receiving hopper;

dropping those items from the conveyor into the receiving hopper to form a stack;

measuring a level of the stack;

maintaining a drop distance between the conveyor and the level of the stack within a desirable range including at least a minimum distance between the level of the stack and the level of the conveyer by operations that include adjusting a speed of the conveyor when the drop distance between the conveyor and the level of the stack is not within the desirable range; wherein the receiving hopper is configured to feed items out of the hopper from off of a bottom of the stack;

the step of maintaining includes performing at least one of the following as item are feed into and out of the hopper:

decreasing the speed of the conveyor when the level of the stack is more than a target fill level so as to decrease the rate at which items are deposited into the hopper; or increasing the speed of the conveyor when the level of the stack is less than a minimum fill level so as to increase the rate at which items are deposited into the hopper.

13. A method as in claim 12, wherein the step of maintaining includes adjusting a height of the conveyor with respect to the receiving hopper when the drop distance between the conveyor and the level of the stack is not within the desirable range.

14. A method as in claim 12, wherein the step of maintaining includes at least one of the following:

raising the conveyor with respect to the receiving hopper when the level of the stack is more than a target fill level; or lowering the conveyor with respect to the receiving hopper when the level of the stack is less than a minimum fill level.

15. A method as in claim 12, wherein the step of maintaining includes adjusting an angle of the conveyor with respect to the receiving hopper when the drop distance between the conveyor and the level of the stack is not within the desirable range.

16. A method as in claim 12, wherein the step of maintaining includes at least one of the following:

raising the delivery end of the conveyor with respect to the receiving hopper when the level of the stack is more than a target fill level; or lowering the delivery end of the conveyor with respect to the receiving hopper when the level of the stack is less than a minimum fill level.

17. A method as in claim 12, including steps of maintaining the level of the stack at about a constant level.

18. A method as in claim 12, wherein the step of maintaining includes increasing the speed of the conveyer to a maximum speed and stopping the items from being feed out of the bottom of the hopper when the level of the stack is less than a low threshold.

19. A method as in claim 12, wherein the step of maintaining includes stopping the conveyer when the level of the stack is at or above an overfill line.

20. A method as in claim 12, wherein the step of measuring the level of the stack includes measuring a distance between the stack and the sensor and determining the level of the stack based on the distance.

21. Apparatus including a conveyor configured to move one or more items toward a receiving hopper, the receiving hopper configured to receive the items into a stack thereof;

a sensor configured to determine a level of the stack;

a controller coupled to the conveyor and configured to maintain a drop distance between the conveyor and the level of the stack within a desirable range that includes at least a minimum distance between the level of the stack and the level of the conveyer; wherein the controller is configured to adjust a speed of the conveyor when the drop distance between the conveyor and the level of the stack is not within the desirable range;

the receiving hopper is configured to feed items out of the hopper from off of a bottom of the stack; and the controller is configured to increase the speed of the conveyer to a maximum speed and to stop the items from being feed out of the bottom of the hopper when the level of the stack is less than a low threshold.

22. Apparatus as in claim 21, wherein the controller is configured to perform at least one of the following:

raise the delivery end of the conveyor with respect to the receiving hopper when the level of the stack is more than a target fill level; or lower the delivery end of the conveyor with respect to the receiving hopper when the level of the stack is less than a minimum fill level.

23. Apparatus as in claim 22, wherein the controller is configured to maintain the level of the stack at about a constant level.

24. Apparatus as in claim 22, wherein a second sensor is positioned within the conveyor, and is configured to detect whether items are falling from the conveyor into the receiving hopper.

25. Apparatus as in claim 24, wherein an output from the second sensor is filtered; and the filtered output indicates when a target fill level is reached.

* * * * *